US005484514A

United States Patent [19]

Katayama

[11] Patent Number: 5,484,514

[45] Date of Patent: Jan. 16, 1996

[54] ELECTROLYZER

[75] Inventor: Shinji Katayama, Tamano, Japan

[73] Assignee: Chlorine Engineers Corp., Ltd., Tokyo, Japan

[21] Appl. No.: 236,273

[22] Filed: May 2, 1994

[30] Foreign Application Priority Data

Apr. 30, 1993 [JP] Japan ..... 5-104429

[51] Int. Cl.[6] ..... C25B 9/00; C25B 15/08

[52] U.S. Cl. ..... 204/255; 204/256; 204/257; 204/258; 204/263; 204/266; 204/269; 204/270

[58] Field of Search ..... 204/255–258, 204/263–266, 269–270, 275–278, 288–289

[56] References Cited

U.S. PATENT DOCUMENTS

| | | | |
|---|---|---|---|
| 3,752,757 | 8/1973 | Stephenson et al. | 204/256 |
| 4,111,779 | 9/1978 | Seko et al. | 204/255 |
| 4,141,815 | 2/1979 | Ichisaka et al. | 204/290 F |
| 4,557,816 | 12/1985 | Yoshida et al. | 204/255 |
| 4,767,519 | 8/1988 | de Nora | 204/289 X |
| 4,839,012 | 6/1989 | Burney, Jr. et al. | 204/257 X |
| 5,194,132 | 3/1993 | Hartmann et al. | 204/257 |
| 5,225,060 | 7/1993 | Noaki et al. | 204/258 X |
| 5,242,564 | 9/1993 | Traini | 204/258 |
| 5,314,591 | 5/1994 | Katayama et al. | 204/289 X |

FOREIGN PATENT DOCUMENTS 3-249189 11/1991 Japan .

*Primary Examiner*—Donald R. Valentine
*Attorney, Agent, or Firm*—Alfred Walker

[57] ABSTRACT

An electrolyzer having a partition plate produced by forming thin plates. The electrolyzer includes a vertical electrolyzer unit which has a partition plate formed by superimposing a pair of anode- and cathode-side partitions provided with mutually fittable recesses and projections, and an electrode plate connected to the projections on each side of the partition plate to define an electrolytic chamber. A gas-liquid separating chamber having a discharge opening is provided in the upper part of the electrolyzer unit such that the cross-sectional area of the gas-liquid separating chamber is larger at a part closer to the discharge opening than at a part remoter from the discharge opening, thereby preventing the fluctuation of pressure in the electrolytic chamber caused by pulsation occurring in the gas-liquid separating chamber.

5 Claims, 5 Drawing Sheets

ELECTROLYZER

BACKGROUND OF THE INVENTION

The present invention relates to filter-press electrolyzers and, more particularly, to a filter-press electrolyzer which is characterized by the arrangement of partitions that divide the electrolyte between a pair of adjacent electrode chambers.

Filter-press electrolyzers are widely used for the electrolytic production of organic substances, the electrolysis of brine, etc., including the production of chlorine and caustic soda by the electrolysis of salt.

Filter-press electrolyzers used for the electrolysis of salt, which is a typical example of electrolytic processes that use a filter-press electrolyzer, include two different types, that is, a bipolar filter-press electrolyzer and a monopolar filter-press electrolyzer. The bipolar filter-press electrolyzer is arranged as follows: A multiplicity of bipolar electrolyzer units, which are formed by electrically and mechanically connecting together a pair of anode and cathode chambers divided by a partition, are stacked with a cation-exchange membrane interposed between each pair of adjacent units. Further, an end electrode chamber unit having an anode on one side thereof is stacked on one end of the stack of the electrolyzer units, while an end electrode chamber having a cathode on one side thereof is stacked on the other end, and the resulting stack is fixed by a hydraulic press or other similar device. The monopolar filter-press electrolyzer is constructed such that a multiplicity of anode chamber units and cathode chamber units, each having the same electrode on each side of an electrode chamber frame, are stacked with a cation-exchange membrane interposed between each pair of adjacent units, and an electrode chamber unit having an anode on one side thereof is stacked on one end of the stack of the units, while an electrode chamber unit having a cathode on one side thereof is stacked on the other end of the stack. The electrode chamber units in the monopolar filter-press electrolyzer are each provided with downcomers, ribs, etc. for reinforcing the electrode chamber frame and also for promoting the circulation of the electrolyte, and the electrodes are attached to the ribs or the like. Usually, these electrode chamber units have no partition for dividing the electrolyte.

On the other hand, the electrode chamber units of the bipolar filter-press electrolyzer are provided with partitions for dividing the anode and cathode chambers and also for transmitting the electrolytic current. Diaphragms that divide a pair of anode and cathode chambers are provided with an anode and a cathode, respectively. Either of the anode and cathode chambers is placed in an acidic environment, and the other in a reducing environment, depending upon the desired electrolytic reaction. Particularly, in the electrolysis of salt, which is a typical electrolytic process that uses an ion-exchange membrane, chlorine is formed at the anode, while highly concentrated sodium hydroxide and hydrogen are formed at the cathode. The anode chamber is formed of a thin-film forming metal, e.g., titanium, tantalum, zirconium, etc., which has high resistance to corrosion from chlorine or the like, or an alloy of such a metal. Under the atmosphere in the cathode chamber, titanium absorbs hydrogen and becomes brittle. Therefore, titanium, which has high resistance to corrosion, cannot be used for the cathode chamber.

For this reason, a ferrous metal or alloy, e.g., iron, nickel, stainless steel, etc., is used for the cathode chamber. Electrical joint can be formed by defining each electrode chamber by a partition of a metallic material and joining the partitions together. However, if titanium that constitutes the anode chamber is welded directly to a ferrous metal, e.g., iron, nickel, stainless steel, etc., which constitutes the cathode chamber, the titanium and the ferrous metal form an intermetallic compound. Therefore, it is impossible to obtain a joint structure having practical strength.

Under these circumstances, various proposals have been made for monopolar electrolyzers. For example, Japanese Patent Application Post-Exam Publication No. 53-5880 (1978) discloses a technique wherein a member of the anode chamber and a member of the cathode chamber are joined together by using a bolt that extends through a partition made of a synthetic resin material.

Japanese Patent Application Post-Exam Publication No. 52-32866 (1977) discloses a technique wherein a partition is formed from a plate-shaped member made of a ferrous metal and titanium which are joined by explosive welding, and ribs are welded to both surfaces of the partition, and then an anode and a cathode are welded to the ribs. Japanese Patent Application Post-Exam Publication No. 56-36231 (1981) uses a composite material formed by joining together titanium and iron with copper sandwiched therebetween. The titanium of the composite material is welded to titanium that constitutes an anode-side partition of a bipolar electrolyzer unit, and the iron of the composite material is similarly welded to a cathode-side partition made of a ferrous metal.

As has been described above, there are various types of partition used in bipolar electrolyzers. In any type of electrolyzer, ribs are connected to a partition, and an electrode is attached to the ribs by welding or other similar method. With this arrangement, however, a voltage drop due to the ribs is unavoidable. In addition, it is necessary to use a special method for joining together the cathode-side metal and the anode-side metal.

To solve these problems, a bipolar electrolyzer has been proposed as Japanese Patent Application Laid-Open (KOKAI) No. 03-249189 (1991) [Japanese Patent Application No. 02-45855 (1990)], which includes an electrolyzer unit having a partition plate formed from two plates pressed to have recesses and projections, which fit to each other, and electrodes are joined to the projections on both sides of the partition plate, thereby providing a simplified structure and facilitating the process for producing the electrolyzer.

In an electrolytic reaction that generates a large amount of gas as in the electrolysis of salt by the ion-exchange membrane method, a region where the content of gas generated or the content of bubbles in the electrolyte is relatively high is formed in the upper part of the electrode chamber. It is known that a region where a gas or bubbles reside has an adverse effect on the ion-exchange membrane in long runs. To reduce the area where a gas or bubbles reside, various schemes have heretofore been carried out: For example, a scheme of optimizing the position of installation of a nozzle for allowing the electrolyte or the gas generated to flow out to the outside; and a scheme of preventing bubbles from contacting the ion-exchange membrane by providing a gas-liquid separating chamber in the upper part of the electrolyzer unit. In an electrolyzer having a large electrode area, if the current distribution in an electrode chamber becomes nonuniform, a phenomenon that is unfavorable for the electrolyzer performance occurs, for example, local wear of the electrodes, and local deterioration of the ion-exchange membrane. Therefore, consideration is given to the position of installation of the electrodes and current collecting members so that the path of current, i.e., anode—partition— cathode—anode, is substantially uniform, thereby allowing the current distribution in the electrode chamber to become uniform.

In addition, it has been schemed to minimize the electrolyte concentration and temperature distributions in the electrode chamber. To minimize these distributions, the conventional practice is to increase the speed or rate of circulation of the electrolyte that is externally supplied into the electrode chamber and discharged therefrom. However, a large-sized circulating device is needed in order to increase the rate of circulation, and satisfactory effect cannot necessarily be obtained in terms of the achievement of a uniform concentration or temperature of the electrolyte.

In the case of an electrolyzer unit formed by pressing flat plates, a region where a gas resides unavoidably occurs in the upper part of the electrode chamber even if consideration is given to the position of installation of an outlet nozzle for the electrolyte or the gas generated.

An effective way of making the electrolyte concentration or temperature uniform is to allow the electrolyte to be uniformly supplied to the electrode chamber. In an electrolyzer unit formed by pressing flat plates, however, an electrolyzer frame member is provided in the lower part of the electrolyzer unit, and it is therefore impossible to provide a device for dispersing the electrolyte. Similarly, it is impossible to provide a gas-liquid separating device for the electrolyte in the upper part of the electrolyzer unit.

The present inventors have previously proposed an electrolyzer unit formed by pressing flat plates and also proposed an electrolyzer wherein an electrolyte dispersing and feeding chamber is provided in the lower part of an electrolyzer unit, and a gas-liquid separating chamber is provided in the upper part of the unit, in Japanese Patent Application Nos. 03-154687 (1991), 03-154688 (1991) and 03-160260 (1991) (U.S. patent application Ser. No. 07/904251), etc.

With the proposed techniques, the quantities of the electrolyte and the generated gas immediately before they are discharged from the electrode chamber to the gas-liquid separating chamber provided in the upper part of the chamber are uniformly distributed in the horizontal direction of the electrolyzer. However, in the gas-liquid separating chamber, the flow rate of the fluid comprised of a gas, a gas-liquid multi-phase flow, a liquid, etc. increases as the fluid approaches the discharge opening. In addition, the speed of the fluid in the chamber increases, and the pressure loss also increases.

Consequently, a pressure difference is produced inside the gas-liquid separating chamber between the discharge side and the side opposite to it. As a result, the gas-liquid multi-phase flow pulsates, causing the pressure in the electrolytic chamber to fluctuate. The fluctuation of pressure in the electrolytic chamber causes vibration of the ion-exchange membrane that divides the anode and cathode chambers, giving rise to problems such as damage to the ion-exchange membrane.

An object of the present invention is to provide an electrolyzer having a gas-liquid separating chamber provided in the upper part of an electrolyzer unit formed by pressing flat plates. The electrolyzer is arranged to prevent vibration of the ion-exchange membrane due to the fluctuation of pressure in the electrolytic chamber caused by pulsation of the gas-liquid multi-phase flow or the like which occurs inside the gas-liquid separating chamber, thereby stabilizing the operation of the electrolyzer and also enabling the ion-exchange membrane to be stably used for a long period of time.

SUMMARY OF THE INVENTION

The present invention provides an electrolyzer including a vertical electrolyzer unit which has a partition plate formed by superimposing a pair of anode- and cathode-side partitions provided with mutually fittable recesses and projections, and an electrode plate connected to the projections on each side of the partition plate to define an electrolytic chamber, and which further has in the upper part thereof a gas-liquid separating chamber for an electrolyte which is formed from a member integral with each of the partitions. In the electrolyzer unit, the area of a cross-section of the gas-liquid separating chamber taken along a plane perpendicular to a flow passage inside the gas-liquid separating chamber which leads to a discharge opening is larger at a part closer to the discharge opening than at a part remoter from the discharge opening.

The electrolyzer may further have in the lower part of the electrolyzer unit an electrolyte dispersing and feeding chamber formed from a member integral with each of the partitions.

The electrolyzer of the present invention includes a vertical electrolyzer unit which has a partition plate formed by superimposing a pair of anode- and cathode-side partitions provided with mutually fittable recesses and projections, and an electrode plate connected to the projections on each side of the partition plate to define an electrolytic chamber, wherein a gas-liquid separating chamber is formed in the upper part of the electrolyzer unit such that the area of a cross-section of the gas-liquid separating chamber taken along a plane perpendicular to a flow passage inside the gas-liquid separating chamber which leads to a discharge opening is larger at a part closer to the discharge opening than at a part remoter from the discharge opening. Accordingly, it is possible to minimize the fluctuation of pressure caused by pulsation occurring when the gas-liquid multi-phase flow generated in the electrolyzer moves toward the discharge opening. Thus, the ion-exchange membrane that divides the cathode and anode chambers can be prevented from being damaged by vibration or the like.

DESCRIPTION OF THE PREFERRED EMBODIMENT

The present invention will be described below with reference to the accompanying drawings.

Figure 1A:
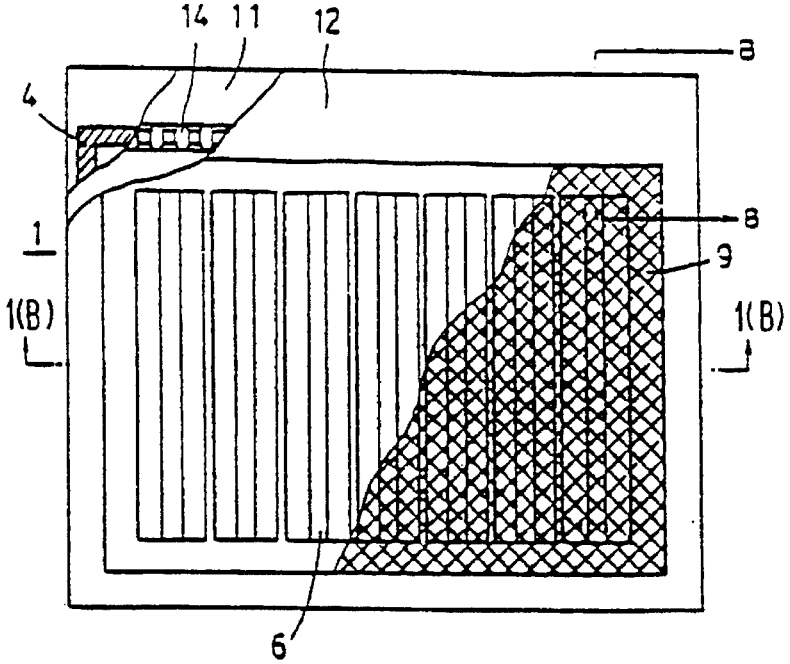
FIG. 1(A) is a plan view showing one embodiment of the electrolyzer according to the present invention.
Figure 1B:
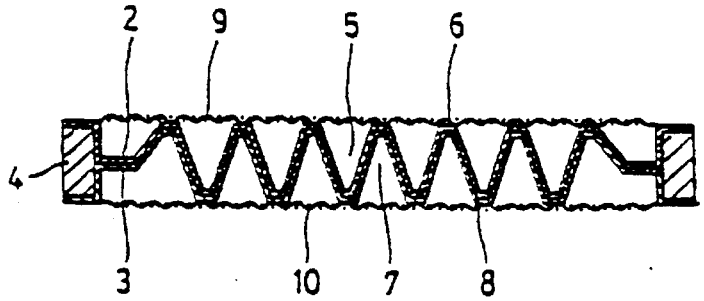
FIG. 1(B) is a sectional view taken along the line 1(B)—1(B) in FIG. 1(A).
Figure 1C:
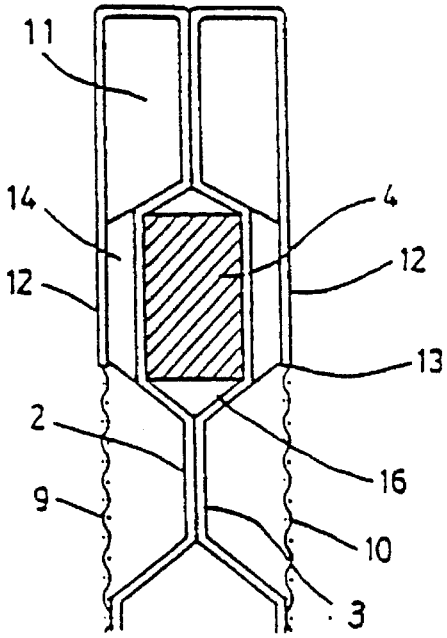
FIG. 1(C) is a fragmentary vertical sectional view of the embodiment.

FIG. 1(A) is a partly cutaway plan view showing one embodiment of the electrolyzer according to the present invention as viewed from the anode side. FIG. 1(B) is a sectional view taken along the line 1(B)—1(B) in FIG. 1(A). FIG. 1(C) is a fragmentary vertical sectional view of the embodiment.

An electrolyzer unit 1 has an anode-side partition 2 which is produced by forming in a pan-shaped configuration a thin plate of a metallic material selected from among thin-film forming metals, e.g., titanium, zirconium, tantalum, etc., and alloys of these metals. A cathode-side partition 3 is similarly produced by forming a thin plate of iron, nickel, stainless steel, etc. The two partitions 2 and 3 are attached to a frame 4 of the electrolyzer. The partitions 2 and 3 are formed with recesses and projections, which fit to each other. More specifically, the anode-side partition 2 is provided with groove-shaped recesses and projections 5 and 6. The cathode-side partition 3 is similarly provided with groove-shaped recesses and projections 7 and 8 at positions where the recesses 7 and the projections 8 fit to the projections 6 and the recesses 5, respectively.

It is preferable not to provide recesses or projections on portions of the partitions 2 and 3 which are adjacent to the upper, lower, left and right wall surfaces of the electrode chambers so that a path for circulation of the electrolyte is formed in each electrode chamber. An anode 9 is connected to the projections 6 of the anode-side partition 2 by welding or other similar method. The anode 9 is made, for example, of an expanded metal plate or a porous plate, which is formed with an anodic activation coating of an oxide of a platinum group metal or the like. Similarly, a cathode 10 is connected to the projections 8 of the cathode-side partition 3 by welding or other similar method. The cathode 10 is made, for example, of an expanded metal plate or a porous plate, which is formed with a cathodic activation coating of a metallic substance selected from nickel and platinum metals.

Gas-liquid separating chambers 11 are provided in the upper part of the electrolyzer unit 1. The gas-liquid separating chambers 11 are formed by bending the anode-side partition 2 and the cathode-side partition 3 as follows: The partitions 2 and 3 which vertically extend so as to wrap the frame 4 are each bent at right angles so as to extend along an imaginary horizontal straight line toward the side where the electrode 9 or 10 is provided, and further bent at right angles with a length corresponding to the thickness of the associated electrode chamber so that the outer surface of the resulting gas-liquid separating chamber forms a flange surface 12 of the electrolyzer unit 1. The distal ends 13 of the partitions 2 and 3 are partially connected to the respective electrodes 9 and 10, thereby fixing the electrodes 9 and 10. Communicating passages 14 are provided between each gas-liquid separating chamber 11 and the associated electrode chamber in order to increase the efficiency of gas-liquid separation.

Figure 2:
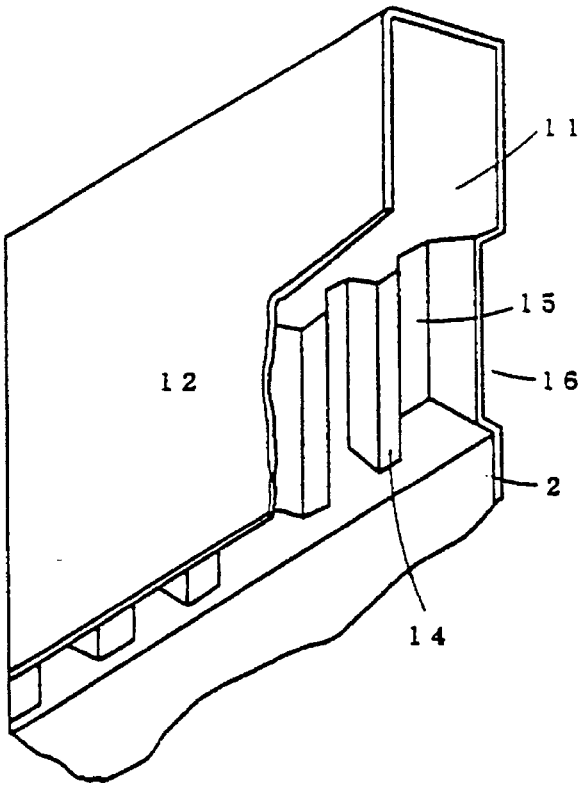
FIG. 2 is a partly cutaway perspective view of a gas-liquid separating chamber in the embodiment of the present invention.

FIG. 2 is a fragmentary perspective view showing one gas-liquid separating chamber 11 with a part thereof cut away. As shown in the figure, the partition 2 (in the illustrated example) is subjected to forming process to provide the communicating passages 14 and also joint surfaces 15 which are joined to the reverse side of the flange surface 12 of the electrolyzer unit 1 to ensure the required mechanical strength for the electrolyzer unit 1. In addition, the partition 2 is formed with a recess 16 for receiving the frame 4, and an end portion of the gas-liquid separating chamber 11 is provided with a discharge opening for taking out the electrolyte and generated gas from the electrolyzer.

Figure 3A:
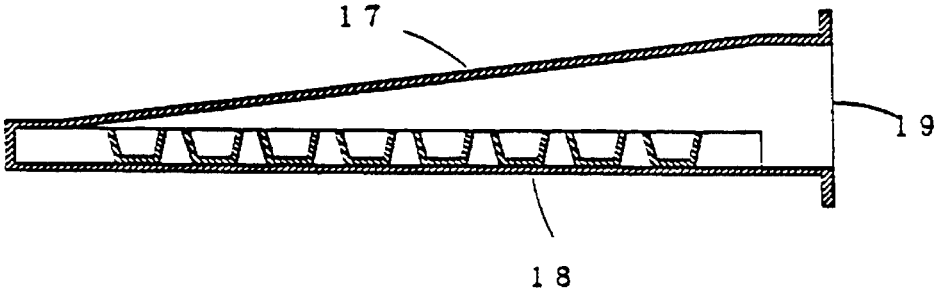
FIGS. 3(A) and 3(B) are sectional views showing gas-liquid separating chambers in the present invention.

FIG. 3(A) is a sectional view showing the structure of a gas-liquid separating chamber in the present invention. As shown in the figure, the spacing between wall surfaces 17 and 18 that constitute a gas-liquid separating chamber is larger at a portion closer to a discharge opening 19 than at a portion remoter from the discharge opening 19. Accordingly, the cross-sectional area becomes larger as the distance to the discharge opening 19 decreases.

Figure 3B:
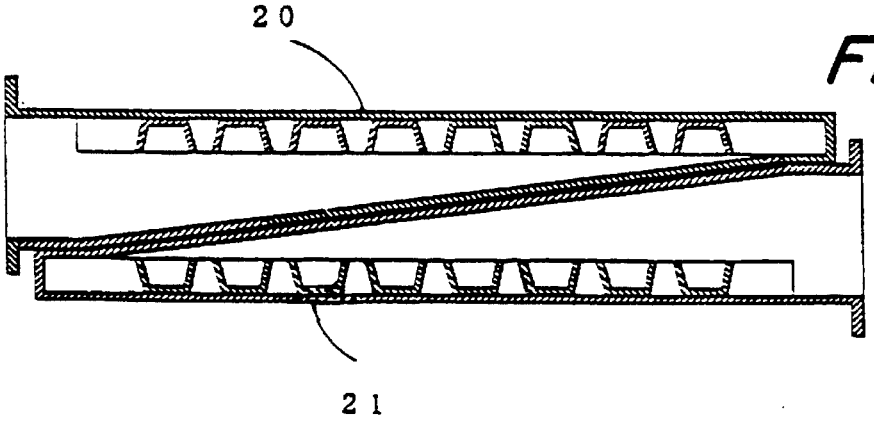

FIG. 3(B) is a sectional view showing an anode-side gas-liquid separating chamber 20 and a cathode-side gas-liquid separating chamber 21, which are stacked with the respective slant surfaces brought into contact with each other so that the overall thickness of the two gas-liquid separating chambers 20 and 21 is the same as the thickness of the electrolyzer unit, thereby enabling the outer surfaces of the gas-liquid separating chambers 20 and 21 to function as flange surfaces of the electrolyzer unit when an electrolyzer is set up.

Anode- and cathode-side partitions are formed with recesses and projections by using a conventional press machine one by one. However, since the anode- and cathode-side partitions may have the same configuration, the same press die can be used for them. Thus, it is necessary to prepare only one press die. In addition, it is possible to form recesses and projections on a pair of anode- and cathode-side partitions and, at the same time, integrate them into one partition plate by pressing the materials of the two partitions in a stacked state. Therefore, the manufacturing process can be simplified.

A pair of anode- and cathode-side partitions may be joined directly by spot welding. Alternatively, the two partitions may be joined with an electrically conductive grease interposed therebetween by fitting the recesses and the projections to each other, thereby forming electrical and mechanical joint, without employing a permanent connecting method such as welding.

The arrangement may be such that an electrolyzer is set up by stacking electrolyzer units, and the inside of each electrode chamber is pressurized so that a pressure difference is produced between the inside and outside of the anode- and cathode-side partitions, thereby enabling the two partitions to come in contact with each other even more effectively. The arrangement may also be such that the space formed between the two partitions and the electrode chamber frame is hermetically sealed, and the pressure in this space is reduced to produce a pressure difference between the space and the electrode chambers, thereby enabling the two partitions to come in contact with each other even more effectively.

Figure 4:
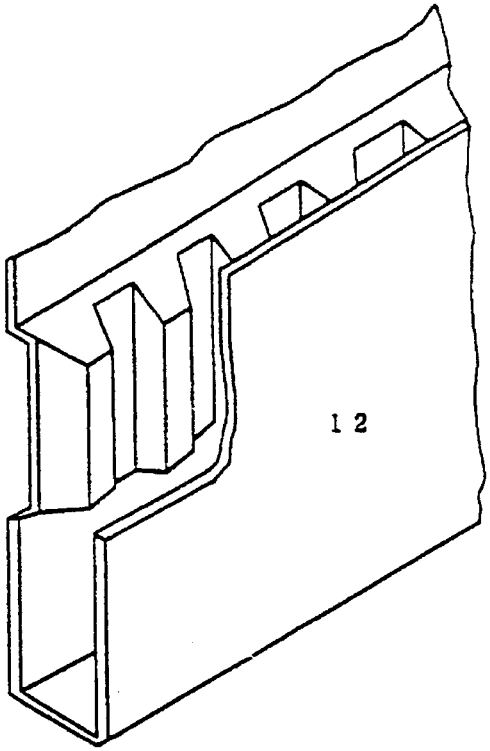
FIG. 4 shows an electrolyte dispersing and feeding chamber provided in the lower part of an electrolyzer unit in the present invention.

In addition, an electrolyte dispersing and feeding chamber may be formed in the lower part of the electrolyzer unit so that the electrolyte is uniformly fed into an electrode chamber, as shown in FIG. 4. The electrolyte dispersing and feeding chamber may be formed in the same way as in the case of the gas-liquid separating chamber. That is, a partition that vertically extends so as to wrap the electrolyzer frame is bent at right angles along an imaginary horizontal straight line toward the side where the electrode is provided, and further bent at right angles with a length corresponding to the thickness of the electrode chamber so that the outer surface of the resulting electrolyte dispersing and feeding chamber forms a flange surface 12 of the electrolyzer unit. Further, the distal end of the partition is partially connected to the electrode to fix the latter.

Passages having a small cross-sectional area are provided between the electrolyte dispersing and feeding chamber and the electrode chamber so that the electrolyte can be fed into the electrode chamber at high speed.

Figure 5A:
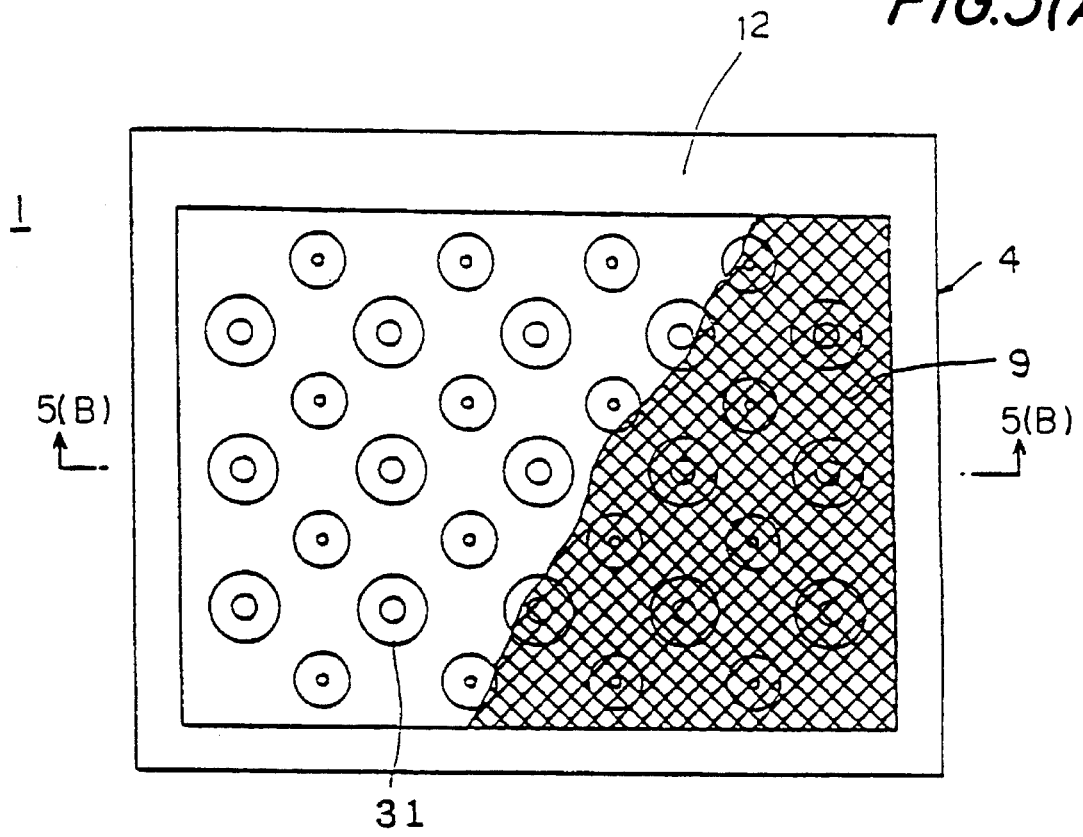
FIGS. 5(A) and 5(B) show another example of recesses and projections provided on partitions in the present invention.
Figure 5B:
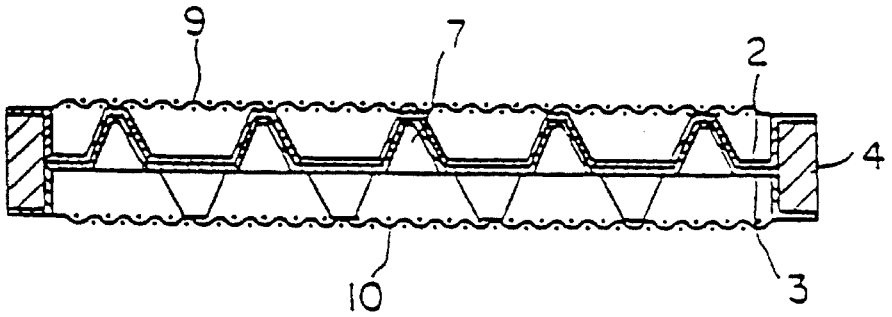

FIGS. 5(A) and 5(B) show another example of the recesses and projections provided on the partitions in the electrolyzer. FIG. 5(A) is a partly cutaway plan view of the electrolyzer, and FIG. 5(B) is a sectional view taken along the line 5(B)—5(B) in FIG. 5(A). In the electrolyzer shown in FIGS. 5(A) and 5(B) , bowl-shaped recesses and projections 31 are formed in place of the groove-shaped recesses and projections as shown in FIG. 1.

Figure 6:
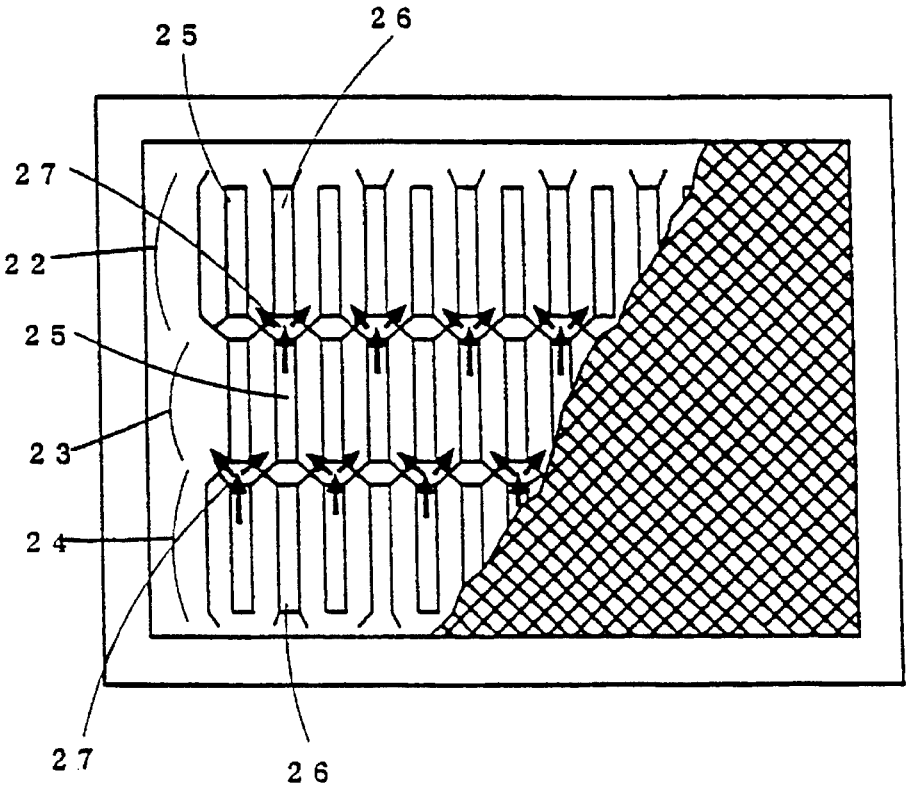
FIG. 6 shows still another example of the recesses and projections provided on the partitions.

As shown in FIG. 6, recesses and projections may be provided in three regions, i.e.-, an upper region 22, a central region 23, and a lower region 24, of a partition. The recesses and projections in each region are formed in the shape of elongated recesses 25 and elongated projections 26, which extend vertically of the electrolyzer unit. In addition, communicating portions 27 are formed between each pair of adjacent regions to provide communication between the adjacent elongated recesses 25 and also provide communication between the elongated recesses 25 in each pair of adjacent regions. The electrolyte is introduced into the electrode chamber from the bottom thereof, and rises through the elongated recesses 25 in the electrode chamber, as shown by the arrows, together with a gas generated in the electrolyzer. The electrolyte further rises while changing the flow path from the communicating portions 27 to the left and right elongated recesses 25. In the process of rising, mixing of the components of the electrolyte progresses. Thus, the concentration of the electrolyte is made uniform.

Figure 7:
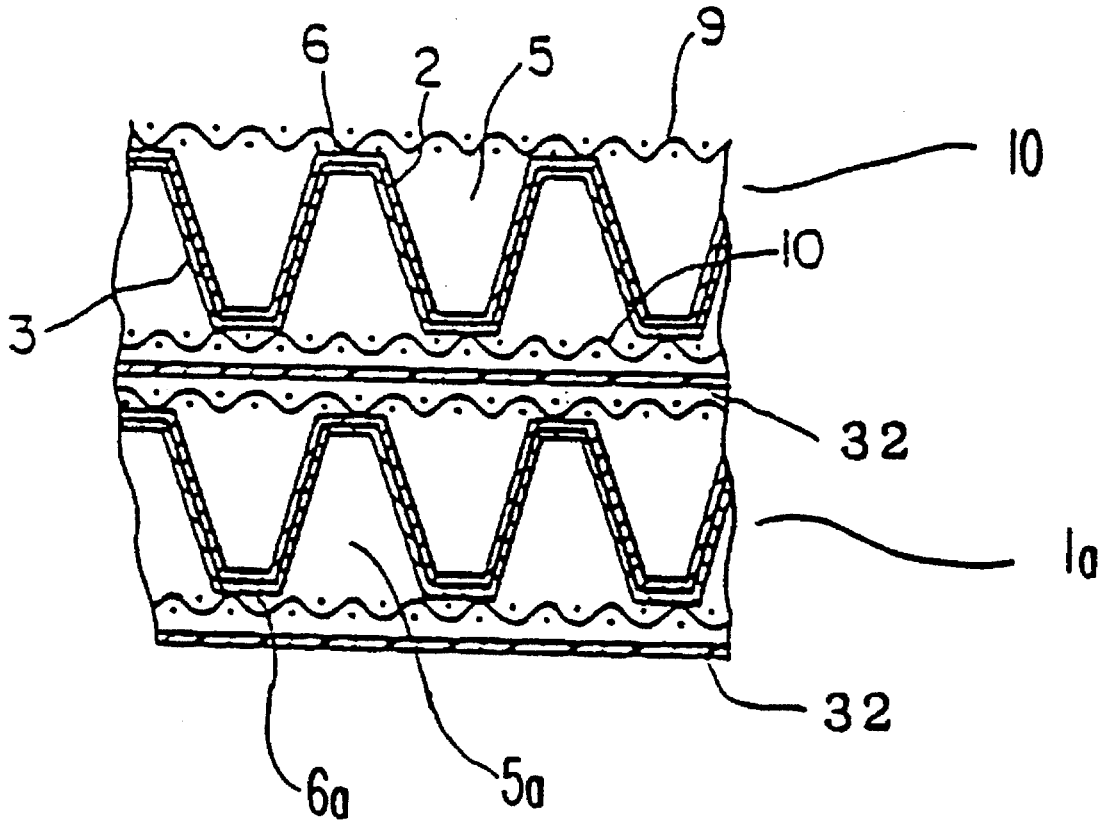
FIG. 7 is a fragmentary sectional view showing a pair of adjacent electrolyzer units joined together when an electrolyzer is set up by stacking a multiplicity of electrolyzer units.

FIG. 7 is a fragmentary sectional view showing a pair of adjacent electrolyzer units joined together when an electrolyzer is set up by stacking a multiplicity of electrolyzer units. It is preferable to dispose a pair of adjacent electrolyzer units such that the projections of one polarity are disposed in the same straight line, and that the projections and recesses of one electrolyzer unit respectively face the recesses and projections of the other electrolyzer unit across an ion-exchange membrane 32, thereby achieving a uniform current distribution.

The recesses and projections are preferably formed over the whole surface of a partition plate. With a view to providing as large a number of electrolyte flow passages as possible, it is preferable that the bottoms of the recesses or the tops of the projections should have a minimal area required for attaching the electrode by welding or other similar method.

Accordingly, the present invention provides an electrolyzer including a vertical electrolyzer unit which has a partition plate formed by superimposing a pair of anode- and cathode-side partitions provided with mutually fittable recesses and projections, and an electrode plate connected to the projections on each side of the partition plate to define an electrolytic chamber, wherein a gas-liquid separating chamber is formed in the upper part of the electrolyzer unit such that the area of a cross-section of the gas-liquid separating chamber taken along a plane perpendicular to a flow passage inside the gas-liquid separating chamber which leads to a discharge opening is larger at a part closer to the discharge opening than at a part remoter from the discharge opening, thereby minimizing the fluctuation of pressure in the electrolytic chamber caused by pulsation occurring when the gas-liquid multi-phase flow generated in the electrolyzer moves toward the discharge opening. Thus, the ion-exchange membrane that divides the cathode and anode chambers can be prevented from being damaged by vibration or the like.

What I claim is:

1. An electrolyzer comprising a vertical electrolyzer unit including a partition plate formed by superimposing a pair of anode- and cathode-side partitions provided with mutually fittable recesses and projections, and an electrode plate connected to said projections on each side of said partition plate to define an electrolytic chamber, and which further includes in an upper part thereof a gas-liquid separating chamber for an electrolyte which is formed from a member integral with each of said partitions, wherein the area of a cross-section of said gas-liquid separating chamber taken along a plane perpendicular to a flow passage of said gas-liquid mixture flow inside said gas-liquid separating chamber, which said flow passage leads to a discharge opening, is larger at a part closer to said discharge opening than at a part farther from said discharge opening.

2. An electrolyzer according to claim 1, which further has in a lower part of said electrolyzer unit an electrolyte dispersing and feeding chamber formed from a member integral with each of said partitions.

3. An electrolyzer according to claim 1, wherein an outer surface of said gas-liquid separating chamber or said electrolyte dispersing and feeding chamber forms a flange surface for stacking said electrolyzer unit on another electrolyzer unit.

4. An electrolyzer according to claim 1, wherein passages are provided between said gas-liquid separating chamber and said electrolytic chamber and between said electrolyte dispersing and feeding chamber and said electrolytic chamber to provide communication between these chambers.

5. An electrolyzer according to claim 1, wherein the mutually fittable recesses and projections formed on the anode- and cathode-side partitions in said vertical electrolyzer unit are elongated recesses and elongated projections, which extend vertically of said electrolyzer unit, said recesses and projections being formed in a plurality of regions divided in the direction of height of said electrolyzer unit such that the elongated recesses in one region in each pair of adjacent regions and the elongated projections in the other region lie on the same straight lines, and communicating portions are provided between each pair of adjacent regions to provide communication between the adjacent elongated recesses in the same region and also provide communication between the elongated recesses in each pair of adjacent regions.

* * * * *